US008769908B1

(12) United States Patent
Santini

(10) Patent No.: US 8,769,908 B1
(45) Date of Patent: Jul. 8, 2014

(54) MODULAR BUILDING PANEL

(76) Inventor: Patrick J. Santini, West Bend, WI (US)

( * ) Notice: Subject to any disclaimer, the term of this patent is extended or adjusted under 35 U.S.C. 154(b) by 65 days.

(21) Appl. No.: 13/597,975

(22) Filed: Aug. 29, 2012

Related U.S. Application Data

(60) Provisional application No. 61/529,354, filed on Aug. 31, 2011.

(51) Int. Cl.
*E04C 2/38* (2006.01)

(52) U.S. Cl.
USPC ..... 52/656.9; 52/79.12; 52/270; 52/653.1; 446/123

(58) Field of Classification Search
USPC ..... 52/79.12, 270, 285.2, 653.1, 656.1, 52/656.9; 446/115, 123
See application file for complete search history.

(56) References Cited

U.S. PATENT DOCUMENTS

| | | | | | |
|---|---|---|---|---|---|
| 1,818,418 | A * | 8/1931 | Millard | 52/263 |
| 2,741,344 | A * | 4/1956 | Herr | 52/211 |
| 2,874,420 | A * | 2/1959 | Henderson | 52/211 |
| 3,001,615 | A * | 9/1961 | Ries | 403/230 |
| 3,783,174 | A * | 1/1974 | Lindgren | 174/373 |
| 3,924,956 | A * | 12/1975 | Fortier | 403/231 |
| 4,739,600 | A * | 4/1988 | Lynch et al. | 52/656.9 |
| 4,754,584 | A * | 7/1988 | Newton, II | 52/106 |
| 4,813,193 | A | 3/1989 | Altizer | |
| 5,060,432 | A * | 10/1991 | Christian | 52/233 |
| 5,216,860 | A * | 6/1993 | Thomson et al. | 52/259 |
| 5,758,463 | A | 6/1998 | Mancini, Jr. | |
| 6,389,778 | B1 * | 5/2002 | Strange | 52/745.19 |
| 6,415,557 | B1 * | 7/2002 | McCalley | 52/79.1 |
| 6,415,558 | B1 * | 7/2002 | Cherry | 52/79.1 |
| 6,510,667 | B1 * | 1/2003 | Cottier et al. | 52/742.14 |
| 6,609,336 | B2 | 8/2003 | Matsubara | |
| 6,945,002 | B2 * | 9/2005 | Zambelli et al. | 52/630 |
| 8,065,852 | B2 * | 11/2011 | Tonyan et al. | 52/745.13 |
| 8,286,352 | B1 * | 10/2012 | Ray | 29/897.312 |
| 8,307,608 | B2 * | 11/2012 | Harig et al. | 52/792.1 |
| 2006/0254166 | A1 * | 11/2006 | Michels et al. | 52/270 |
| 2007/0137134 | A1 * | 6/2007 | Plagemann et al. | 52/656.9 |
| 2013/0180190 | A1 * | 7/2013 | Bovet et al. | 52/220.1 |

* cited by examiner

*Primary Examiner* — Adriana Figueroa
(74) *Attorney, Agent, or Firm* — Donald J. Ersler

(57) ABSTRACT

A modular building panel preferably includes a plurality of lengthwise members, two end members, four corner members and a surface panel. Each lengthwise member and end member includes a first flange, a base member and a second flange. Preferably, two rows of base holes are formed in the base member and one row of first flange holes is formed in the first flange. The base and flange holes are sized to receive fasteners for assembling a plurality of modular building panels in either parallel or perpendicular orientations. Both ends of the lengthwise members are modified for insertion into the two end members. The second flanges of the lengthwise and end members are attached to the surface panel with fasteners. The four corner members are inserted into four corner cavities created by the junction of the two outside lengthwise members and the two end members and secured thereto.

14 Claims, 7 Drawing Sheets

MODULAR BUILDING PANEL

CROSS-REFERENCES TO RELATED APPLICATIONS

This is a nonprovisional patent application taking priority from provisional application No. 61/529,354 filed on Aug. 31, 2011.

BACKGROUND OF THE INVENTION

1. Field of the Invention

The present invention relates generally to creating temporary structures and more specifically to a modular building panel, which may be used to create walls, floors, ceilings and roofs for temporary structures.

2. Discussion of the Prior Art

U.S. Pat. No. 4,813,193 to Altizer discloses a modular building panel. U.S. Pat. No. 5,758,463 to Mancini, Jr. discloses a composite modular building panel. U.S. Pat. No. 6,427,407 to Wilson discloses modular building panels and method of constructing walls from the same. U.S. Pat. No. 6,609,336 to Matsubara discloses modular units, modular structures having modular units, and method for constructing structures.

Accordingly, there is a clearly felt need in the art for a modular building panel, which may be used to create walls, floors, ceilings and roofs for temporary structures.

SUMMARY OF THE INVENTION

The present invention provides a modular building panel, which may be used to create walls, floors, ceilings and roofs for temporary structures. The modular building panel preferably includes a plurality of lengthwise members, two end members, four corner members and a surface panel. The plurality of lengthwise members and the two end members are preferably U-channels, but other structural components may also be used. Each U-channel includes a first flange, a base member and a second flange. The first flange extends from one end of the base member and the second flange extends from an opposing end of the base member.

A row of first base holes is formed through the base member, adjacent a junction between the first flange and the base member.

A row of second base holes is formed through the base member, adjacent a junction between the second flange and the base member.

A row of first flange holes is formed through the first flange, adjacent a junction between the first flange and the base member.

The first base holes, the second base holes and the first flange holes are sized to receive fasteners for assembling a plurality of modular building panels in either parallel or perpendicular orientations.

An end portion of the first and second flanges at each end of each lengthwise member is removed to provide clearance for insertion into an inner perimeter of the two end members. An end portion of the first and second flanges at each end of each end member is removed to provide clearance for the four corner members. The four corner members are preferably rectangular tubes, but other structural components may also be used.

At assembly, one end of at least one middle lengthwise member is inserted into the inner perimeter of one of the end members. The other end of the at least one middle lengthwise member is inserted into the inner perimeter of the other end member. A plurality of fasteners are used to secure the at least one middle lengthwise member and the two end members to the surface panel. One outside lengthwise member is placed in contact with one end of the two end members and a second outside lengthwise member is placed in contact with the other end of the two end members. A plurality of fasteners are used to secure the two outside lengthwise members to the surface panel. The four corner members are inserted into four corner cavities created by the junction of the two outside lengthwise members and the two end members. The four corner members are preferably secured to at least one of the two outside lengthwise members and two end members.

Accordingly, it is an object of the present invention to provide a modular building panel, which may be used to create walls, floors, ceilings and roofs for temporary structures.

These and additional objects, advantages, features and benefits of the present invention will become apparent from the following specification.

DETAILED DESCRIPTION OF THE PREFERRED EMBODIMENTS

Figure 1:
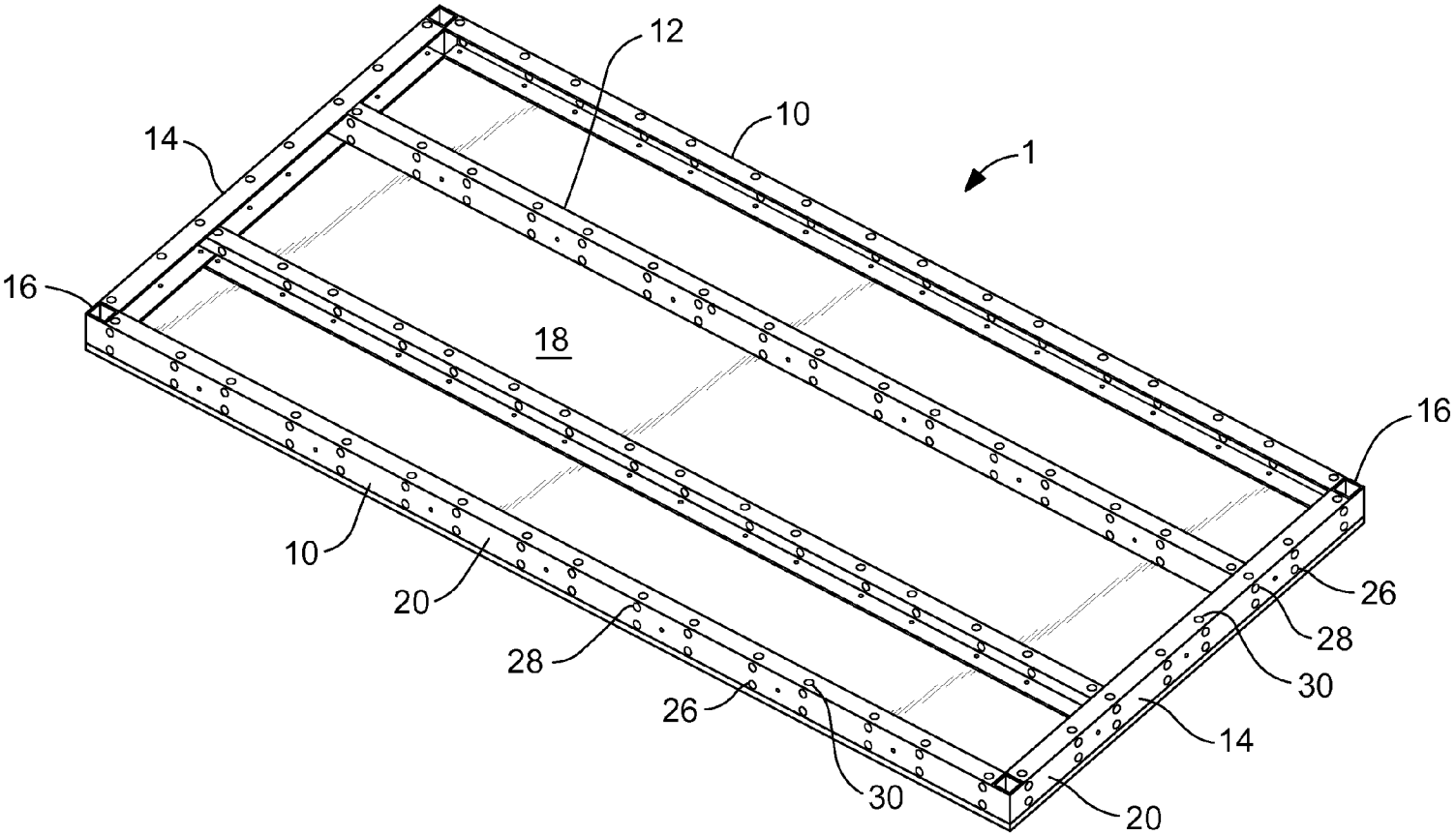
FIG. 1 is a bottom perspective view of a modular building panel in accordance with the present invention.
Figure 2:
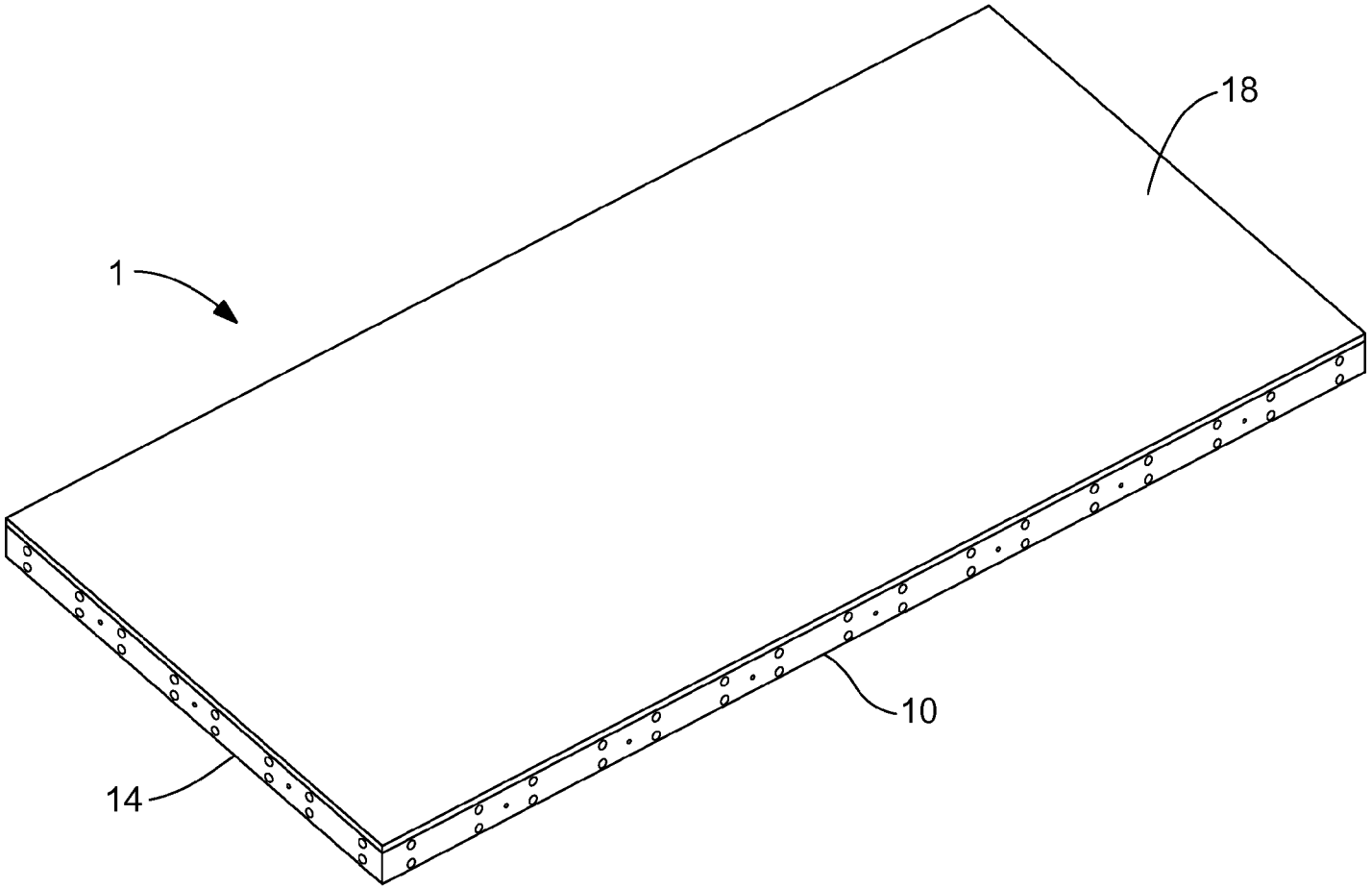
FIG. 2 is a top perspective view of a modular building panel in accordance with the present invention.
Figure 5:
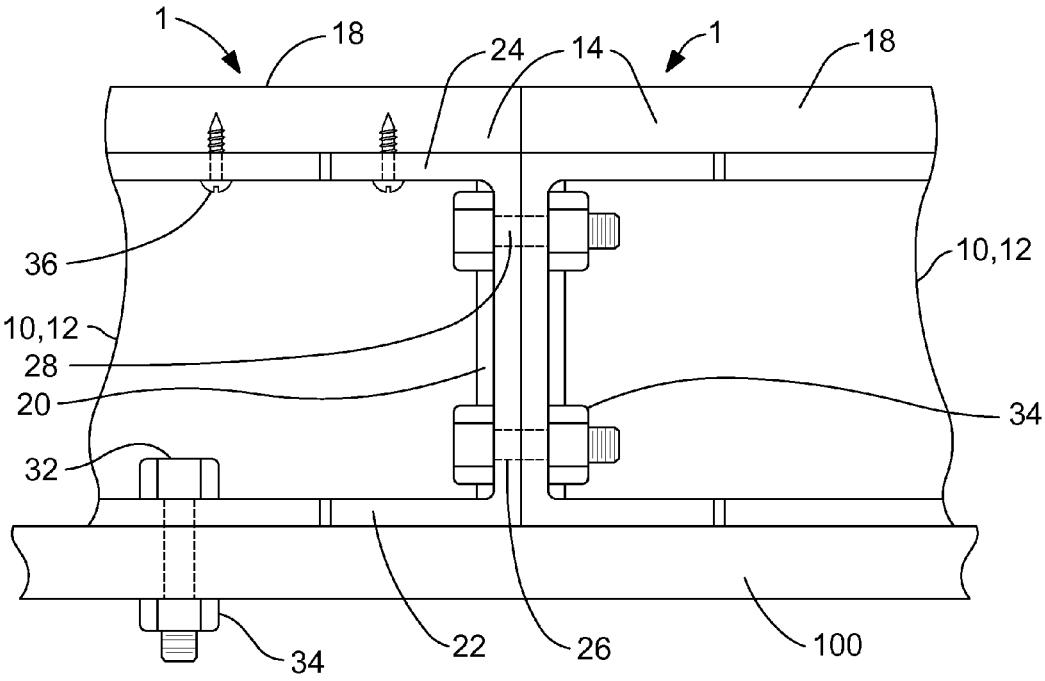
FIG. 5 is an enlarged side view of a first modular building panel attached to a second modular building panel in a parallel orientation in accordance with the present invention.

With reference now to the drawings, and particularly to FIG. 1, there is shown a bottom perspective view of a modular building panel 1. With reference to FIG. 2, the modular building panel 1 preferably includes a plurality of lengthwise members 10, 12, two end members 14, four corner members 16 and a surface panel 18. The plurality of lengthwise members 10, 12 and the two end members 14 are preferably U-channels, but other structural components may also be used. With reference to FIG. 5, each U-channel includes a first flange 22, a base member 20 and a second flange 24. The first flange 22 extends from one end of the base member 20 and the second flange 24 extends from an opposing end of the base member 20.

Figure 6:
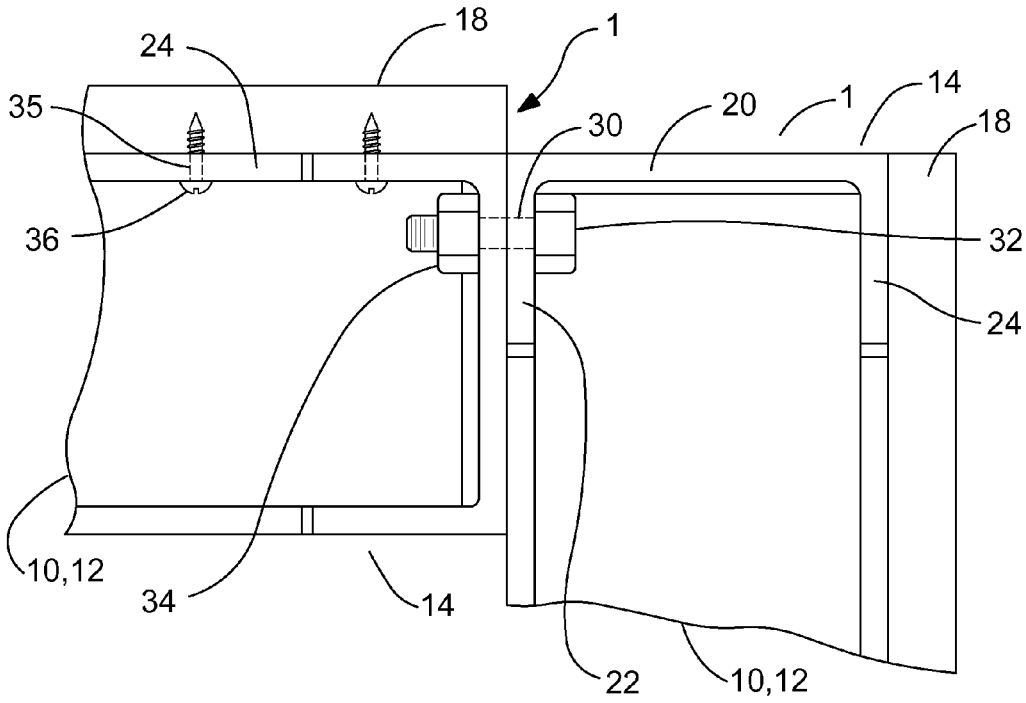
FIG. 6 is an enlarged side view of a first modular building panel attached to a second modular building panel in a perpendicular orientation in accordance with the present invention.

A row of first base holes 26 is formed through the base member 20, adjacent a junction between the first flange 22 and the base member 20. A row of second base holes 28 is formed through the base member 20, adjacent a junction between the second flange 24 and the base member 20. With reference to FIG. 6, a row of first flange holes 30 is formed through the first flange 22, adjacent a junction between the first flange 22 and the base member 20. The first base holes 26, the second base holes 28 and the first flange holes 30 are sized to receive fasteners 32, 34 for assembling a plurality of modular building panels 1. A row of second flange holes 35 is formed through the second flange 24.

Figure 3:
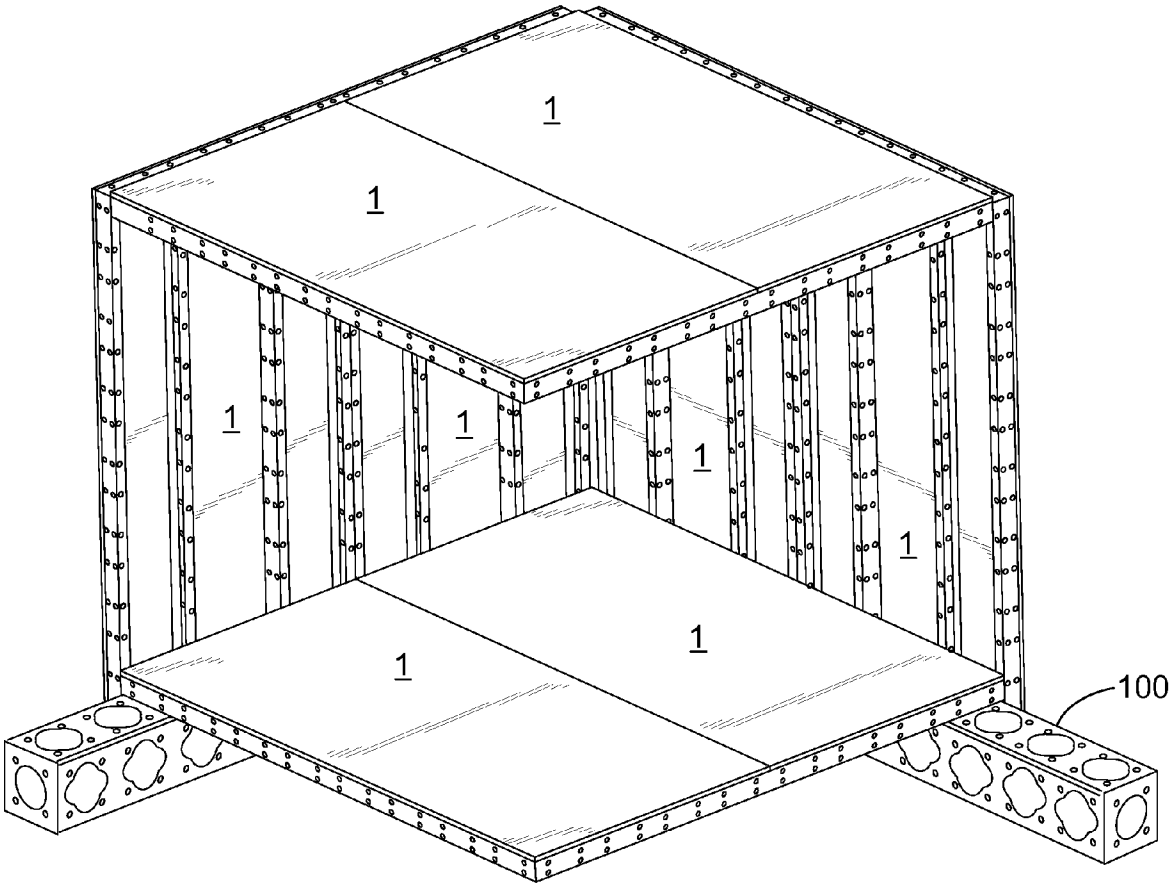
FIG. 3 is a top perspective view of eight modular building panels attached to a support structure and to each other in accordance with the present invention.
Figure 4:
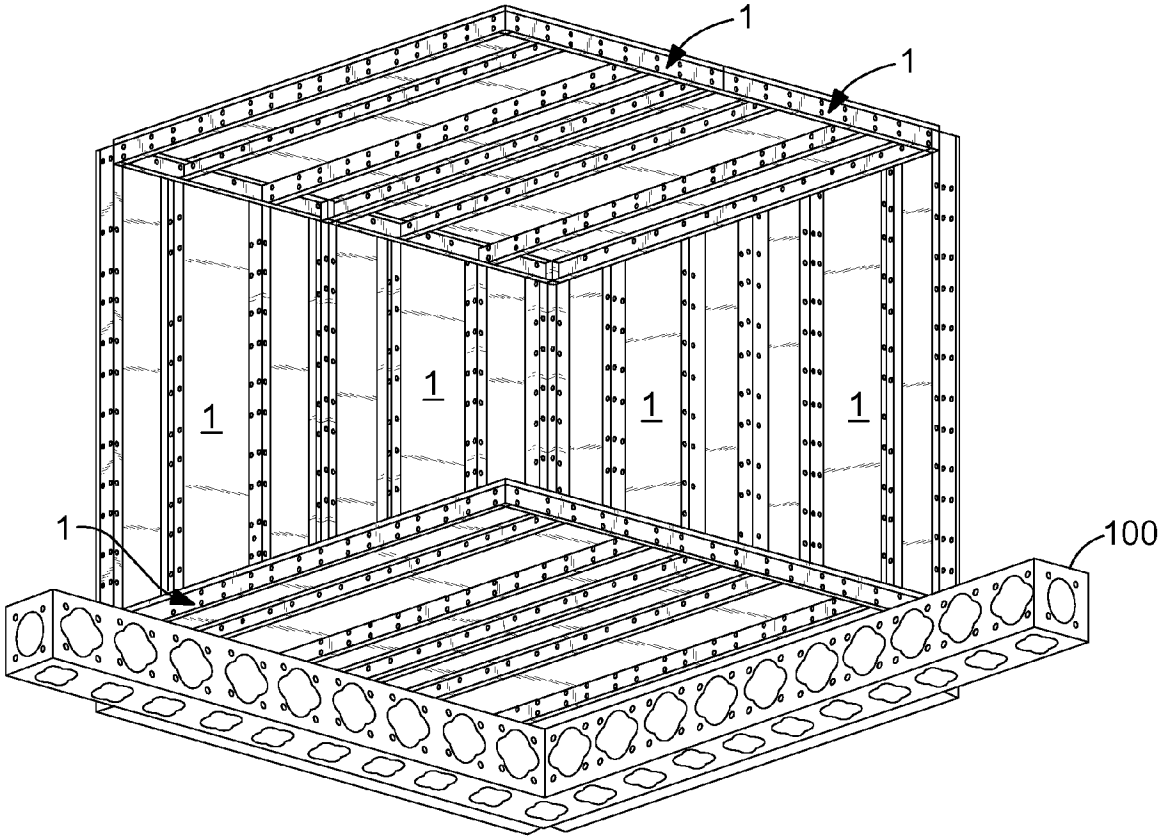
FIG. 4 is a bottom perspective view of a eight modular building panels attached to a support structure and to each other in accordance with the present invention.

FIG. 5 shows two modular building panels 1 assembled to each other in a parallel orientation with the fasteners 32, 34. One of the two modular building panels 1 is attached to a support structure 100 with the fasteners 32, 34. FIG. 6 shows two modular building panels 1 assembled to each other with the fasteners 32, 34 in a perpendicular orientation. FIG. 3 shows a top perspective view of eight modular building panels 1 attached to the support structure 100 for forming two walls, a floor and a ceiling/roof. FIG. 4 shows a bottom perspective view of eight modular building panels 1 attached to the support structure 100 for forming two walls, a floor and a ceiling/roof.

Figure 7:
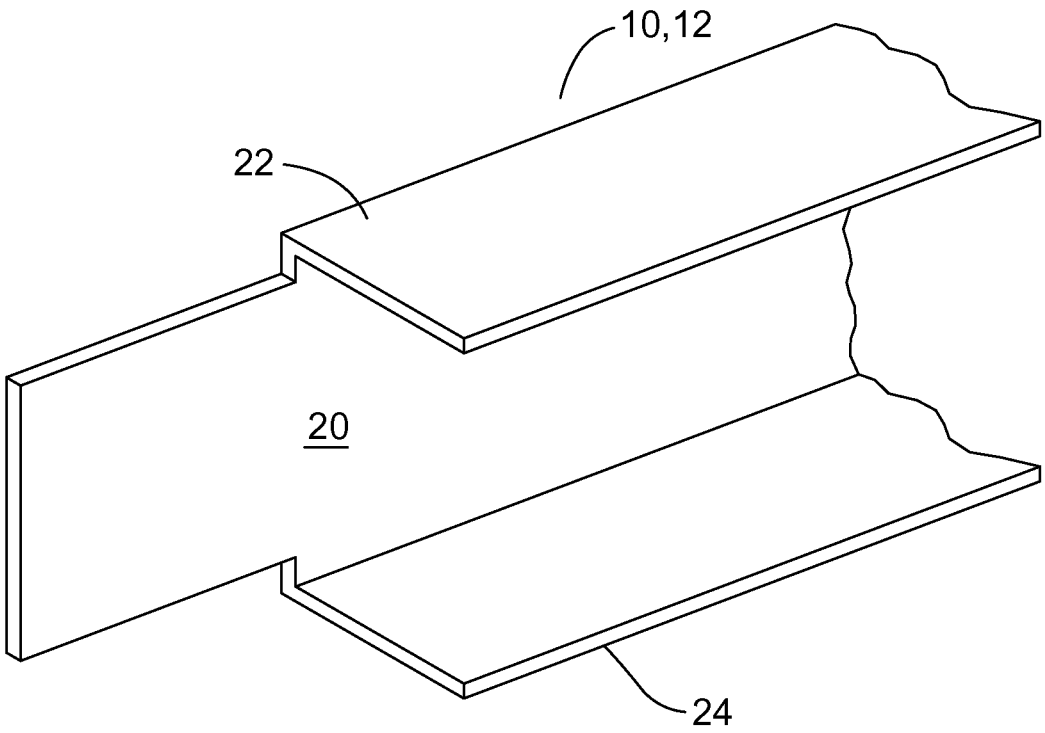
FIG. 7 is an enlarged perspective view of one end of a lengthwise member of a modular building panel in accordance with the present invention.

With reference to FIG. 7, an end portion of the first and second flanges at each end of each lengthwise member 10, 12 is removed to provide clearance for insertion into an inner perimeter of the two end members 14. An end portion of the first and second flanges of the two end members are also removed to provide clearance for the four corner members 16. The four corner members 14 are preferably rectangular tubes, but other structural components may also be used.

At assembly, one end of at least one middle lengthwise member 12 is inserted into the inner perimeter of one of the two end members 14. The other end of at least one middle lengthwise member 12 is inserted into the inner perimeter of the other one of the two end members 14. Each end of the at least one middle lengthwise member 12 is preferably welded to the two end members 14. A plurality of fasteners 36 are used to secure the at least one middle lengthwise members 12 and the two end members 14 to the surface panel 18. One outside lengthwise member 10 is placed in contact with one end of the two end members 14 and a second outside lengthwise member 10 is placed in contact with the other end of the two end members 14. The open ends of the two lengthwise members 10 preferably face inward toward each other. The plurality of fasteners 36 are used to secure the two outside lengthwise members 10 to the surface panel 18. The four corner members 16 are inserted into four corner cavities created by the junction of the two outside lengthwise members 10 and the two end members 14. The four corner members 16 are preferably secured to at least one of the two outside lengthwise 10 members and two end members 14 with any suitable method, such as welding.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A modular building panel comprising:

a plurality of lengthwise members having a U-shaped cross section, said U-shaped cross section includes a lengthwise base member and two lengthwise flanges extending from opposing ends of said lengthwise base member, at least one row of base holes is formed through said lengthwise base member, one row of flange holes is formed through one of said two lengthwise flanges, an end portion of said two lengthwise flanges at each end of said plurality of lengthwise members is removed for insertion of said lengthwise base member into an open end of said two end members;

two end members having a U-shaped cross section, said U-shaped cross section includes an end base member and two end flanges extending from opposing ends of said end base member, at least one row of base holes is formed through said end base member, one row of flange holes is formed through one of said two end flanges, an end portion of said two end flanges at each end of said two end members is removed to allow the insertion of a corner member into each corner of said modular building panel; and a surface panel is secured to the other one of said two lengthwise and end flanges.

2. The modular building panel of claim 1 wherein:

said lengthwise base member and said end base member is attached to said corner member.

3. The modular building panel of claim 1, further comprising:

a plurality of fasteners for securing said surface panel to the other one of said two lengthwise and end flanges.

4. The modular building panel of claim 1, further comprising:

a plurality of fasteners for insertion through said holes to attach two adjacent modular building panels to each other.

5. The modular building panel of claim 1, further comprising:

a plurality of fasteners for insertion through said flange holes to attach said modular building panel to a support structure.

6. A modular building panel comprising:

a plurality of lengthwise members having a U-shaped cross section, said U-shaped cross section includes a lengthwise base member and two lengthwise flanges extending from opposing ends of said lengthwise base member, two rows of base holes are formed through said lengthwise base member, one row of flange holes is formed through one of said two lengthwise flanges, an end portion of said two lengthwise flanges at each end of said plurality of lengthwise members is removed for insertion of said lengthwise base member into an open end of said two end members;

two end members having a U-shaped cross section, said U-shaped cross section includes an end base member and two end flanges extending from opposing ends of said end base member, two rows of base holes are formed through said end base member, one row of flange holes is formed through one of said two end flanges, an end portion of said two end flanges at each end of said two end members is removed to allow the insertion of a corner member into each corner of said modular building panel; and a surface panel is secured to the other one of said two lengthwise and end flanges.

7. The modular building panel of claim 6 wherein:

said lengthwise base member and said end base member is attached to said corner member.

8. The modular building panel of claim 6, further comprising:

a plurality of fasteners for securing said surface panel to the other one of said two lengthwise and end flanges.

9. The modular building panel of claim 6, further comprising:

a plurality of fasteners for insertion through said holes to attach two adjacent modular building panels to each other.

10. The modular building panel of claim 6, further comprising:

a plurality of fasteners for insertion through said flange holes to attach said modular building panel to a support structure.

11. A modular building panel comprising:

a plurality of lengthwise members having a U-shaped cross section, said U-shaped cross section includes a lengthwise base member and two lengthwise flanges extending from opposing ends of said lengthwise base member, at least one row of base holes is formed through said lengthwise base member, one row of flange holes is formed through one of said two lengthwise flanges, an end portion of said two lengthwise flanges at each end of said plurality of lengthwise members is removed for insertion of said lengthwise base member into an open end of said two end members;

two end members having a U-shaped cross section, said U-shaped cross section includes an end base member and two end flanges extending from opposing ends of said end base member, at least one row of base holes is formed through said end base member, one row of flange holes is formed through one of said two end flanges, an end portion of said two end flanges at each end of said two end members is removed to allow the insertion of a corner member into each corner of said modular building panel;

said lengthwise base member and said end base member is attached to said corner member; and a surface panel is secured to the other one of said two lengthwise and end flanges.

12. The modular building panel of claim 11, further comprising:

a plurality of fasteners for securing said surface panel to the other one of said two lengthwise and end flanges.

13. The modular building panel of claim 11, further comprising:

a plurality of fasteners for insertion through said holes to attach two adjacent modular building panels to each other.

14. The modular building panel of claim 11, further comprising:

a plurality of fasteners for insertion through said flange holes to attach said modular building panel to a support structure.

* * * * *